US007053852B2

(12) United States Patent
Timofeev et al.

(10) Patent No.: US 7,053,852 B2
(45) Date of Patent: May 30, 2006

(54) CROSSED DIPOLE ANTENNA ELEMENT

(75) Inventors: Igor E. Timofeev, Dallas, TX (US); Ky Q. Chau, Arlington, TX (US)

(73) Assignee: Andrew Corporation, Orland Park, IL (US)

( * ) Notice: Subject to any disclaimer, the term of this patent is extended or adjusted under 35 U.S.C. 154(b) by 97 days.

(21) Appl. No.: 10/843,999

(22) Filed: May 12, 2004

(65) Prior Publication Data

US 2005/0253769 A1 Nov. 17, 2005

(51) Int. Cl.
*H01Q 21/26* (2006.01)

(52) U.S. Cl. ..... 343/797; 343/793; 343/795

(58) Field of Classification Search ..... 343/793, 343/797, 795, 821, 853
See application file for complete search history.

(56) References Cited

U.S. PATENT DOCUMENTS 3,369,245 A 2/1968 Rea ..... 343/795
5,952,983 A * 9/1999 Dearnley et al. ..... 343/817
5,966,102 A 10/1999 Runyon ..... 343/820
6,034,649 A * 3/2000 Wilson et al. ..... 343/795
6,069,590 A 5/2000 Thompson, Jr. et al. .... 343/795
6,072,439 A 6/2000 Ippolito et al. ..... 343/797
6,211,840 B1 4/2001 Wood et al. ..... 343/793
6,608,600 B1 8/2003 Eriksson ..... 343/797
6,717,555 B1 4/2004 Teillet et al. ..... 343/797

* cited by examiner

*Primary Examiner*—Shih-Chao Chen
(74) *Attorney, Agent, or Firm*—Welsh & Katz, Ltd.

(57) ABSTRACT

A crossed dipole antenna element comprising first and second dipoles, each dipole having a pair of arms, each arm having a first portion extending from a central axis and a second portion extending out of a plane including the first portion and the central axis. In certain embodiments the second portions of the arms of the first dipole extend in a first rotational direction and the second portions of the arms of the second dipole extend in a second rotational direction. This improves the isolation performance of the antenna. In certain embodiments the second portion of each arm branches out at an intermediate position along the length of the arm. This improves the bandwidth performance of the antenna.

27 Claims, 17 Drawing Sheets

CROSSED DIPOLE ANTENNA ELEMENT

FIELD OF THE INVENTION

The present invention relates to a crossed dipole antenna element. The element may be used in a variety of antennas including, but not limited to, dual-polarized or circularly polarized antennas.

BACKGROUND OF THE INVENTION

Base stations used in wireless telecommunication systems have the capability to receive linear polarized electromagnetic signals. These signals are then processed by a receiver at the base station and fed into the telephone network. In practice, the same antenna which receives the signals can also be used to transmit signals. Typically, the transmitted signals are at different frequencies to the received signals. Receiving signals on two orthogonal polarizations helps to reduce fading caused by multiple reflections at buildings, trees etc.

An array of slant 45. degree polarized radiating elements is constructed using a linear or planar array of crossed dipoles located above a ground plane. A crossed dipole is a pair of dipoles whose centers are co-located and whose axes are (in general) orthogonal. The axes of the dipoles are arranged such that they are parallel with the polarization sense required. In other words, the axis of each of the dipoles is positioned at some angle with respect to the vertical axis of the antenna array.

One problem associated with a crossed dipole configuration is the interaction of the electromagnetic field of each crossed dipole with the fields of the other crossed dipoles and the surrounding structures which support, house and feed the crossed dipoles. As is well known in the art, the radiated electromagnetic fields surrounding the dipoles transfer energy to each other. This mutual coupling influences the correlation of the two orthogonally polarized signals. The opposite of coupling is isolation, i.e., coupling of −30 dB is equivalent to 30 dB isolation. Dual polarized antennas have to meet a certain port-to-port isolation specification.

Another problem associated with antennas in general, is the provision of an antenna element with an appropriate band width performance.

A conventional crossed dipole antenna is shown in U.S. Pat. No. 6,072,839. Six crossed dipole assemblies are mounted in line along a reflector, with a parasitic element located between the inner two dipole assemblies to improve isolation. A disadvantage of parasitic elements is that they disturb the radiation field of the antenna, creating unwanted side lobes and/or decreasing polarization purity.

A crossed-drooping bent dipole antenna is shown in U.S. Pat. No. 6,211,840. In one form the ends of the dipole arms are bent back towards the central axis in a plane parallel to the central axis. In another form the ends of the dipole arms are bent in the same rotational direction out of a plane which includes the central axis.

The bent arms are designed to improve gain and axial ratio at low elevation angles.

BRIEF SUMMARY OF EXEMPARY EMBODIMENTS

A first set of exemplary embodiment provide a crossed dipole antenna element comprising first and second dipoles, each dipole having a pair of arms, each arm having a first portion extending from a central axis and a second portion extending out of a plane including the first portion and the central axis, wherein the second portions of the arms of the first dipole extend in a first rotational direction and the second portions of the arms of the second dipole extend in a second rotational direction.

It has been found that the second portions cause an improvement in isolation. This is a surprising result since all previous isolating elements have been parasitic elements which are not conductively connected to the dipole arms. In contrast, the second portion of the arm essentially forms part of the dipole arm—that is, it is conductively connected to the first portion. It is thought that currents on the projecting second portion radiate energy that cancels the energy which couples from one polarization to another. Alternatively, the improved isolation may be a result of diffraction effects.

The second portion may be formed by bending part of a respective arm to one side, or by separately forming the second portion and attaching it by a conductive connection (such as a solder joint) to the first portion.

A second set of exemplary embodiments provide a crossed dipole antenna element comprising first and second dipoles, each dipole having a pair of arms, each arm including a first portion extending from a central axis and a second portion extending out of a plane including the first portion and the central axis, wherein the second portion of each arm branches out from the arm at an intermediate position along the length of the arm.

This branched arm geometry effectively "widens" the arm (as viewed along the central axis). It is believed that this effective "widening" influences the band width of the antenna. The second portion may be formed by bending part of a respective arm to one side, or by separately forming the second portion and attaching it by a conductive connection (such as a solder joint) to the arm at the intermediate position.

BRIEF DESCRIPTION OF THE DRAWINGS

The accompanying drawings which are incorporated in and constitute part of the specification, illustrate embodiments of the invention and, together with the general description of the invention given above, and the detailed description of the embodiments given below, serve to explain the principles of the invention.

DETAILED DESCRIPTION OF EMBODIMENTS OF THE INVENTION

Figure 1:
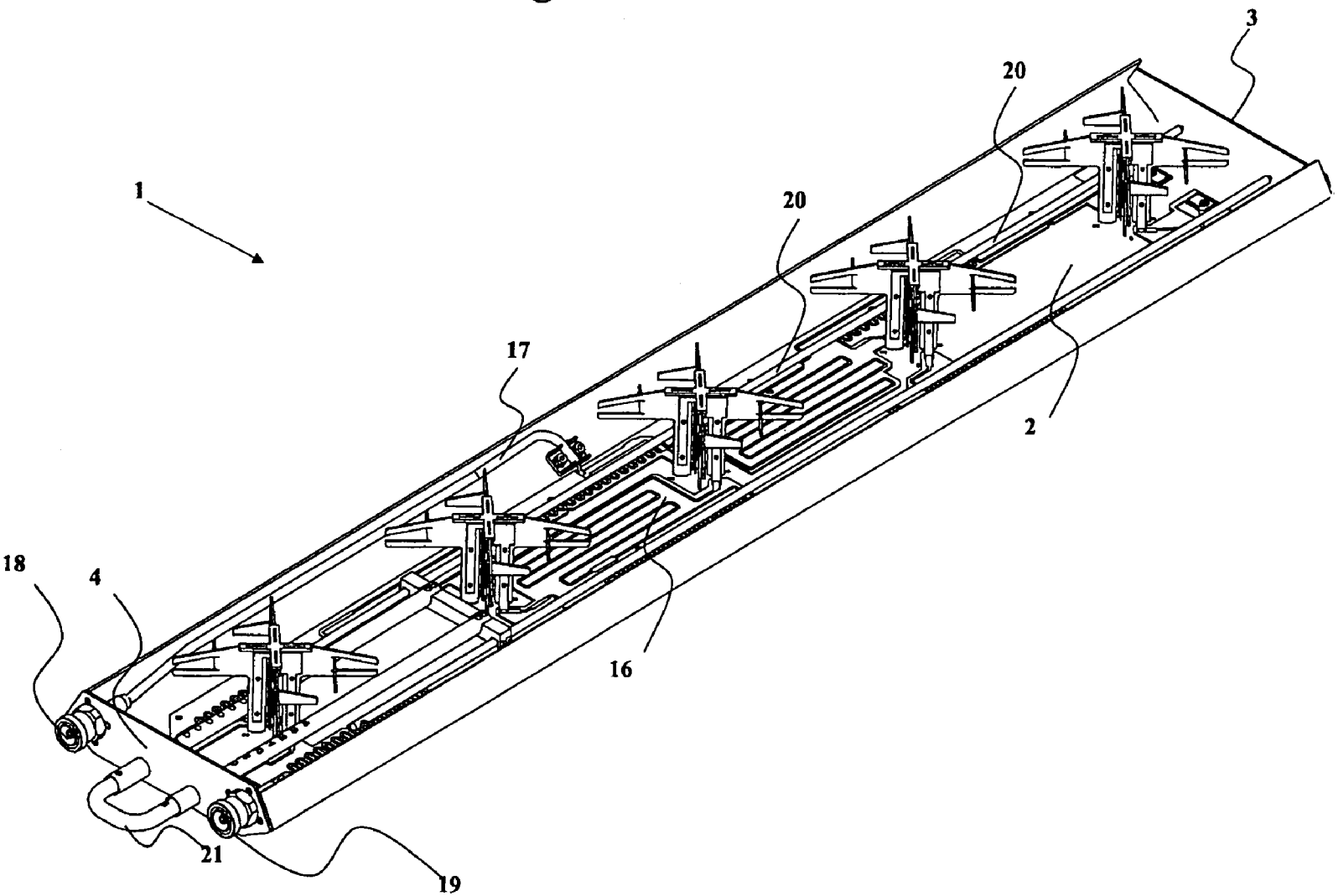
FIG. 1 is a perspective view of a base station antenna.

Referring to FIGS. 1 to 5, antenna 1 has an Aluminum tray with a base 2, a pair of end walls 3,4 and a pair of identically formed side walls. The tray is formed from a single piece and bent into the shape shown. The profile of the side walls is shown most clearly in FIG. 5. Each side wall has an outwardly angled portion 5, and an inwardly angled portion 6. The side walls contribute to the 90 degree azimuthal beam width of the antenna. The shape of the side walls also helps to make the antenna stronger mechanically and suppresses back radiation.

Figure 6:
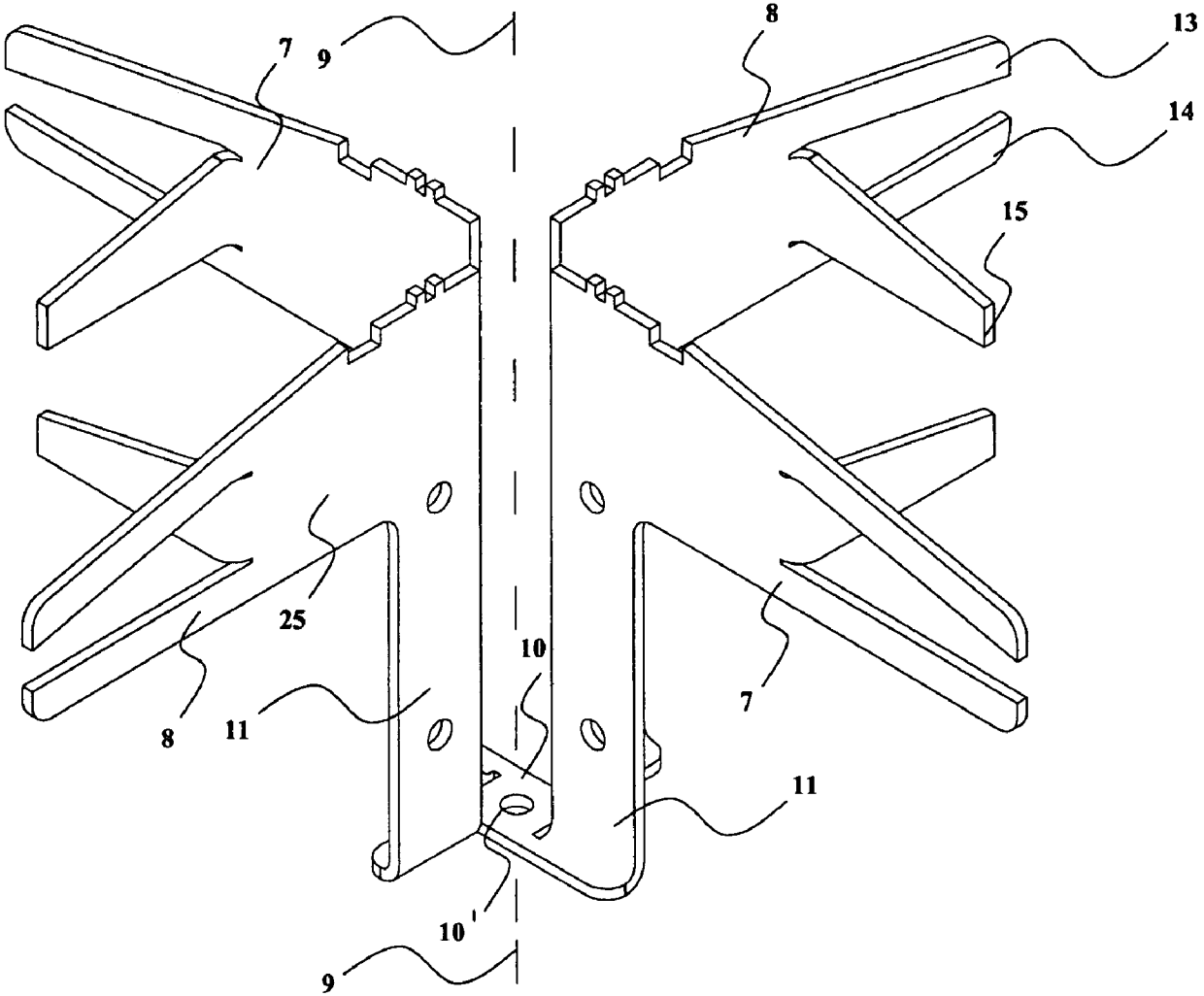
FIG. 6 is a perspective view of one of the dipole assemblies with the plastic clip and baluns omitted.

Five crossed dipole assemblies are mounted in a straight line along the antenna axis on the base of the tray. The assemblies are similar to the assemblies shown in U.S. Pat. No. 6,717,555, the disclosure of which is incorporated herein by reference. The crossed dipole assemblies transmit and receive radiation. One of the crossed dipole assemblies is shown in detail in FIGS. 6 to 10. Referring first to FIG. 6, a +45 degree dipole 7 and a −45 degree dipole 8 are formed from a single piece which is cut and folded into the form shown. A base 10 is mounted to the base 2 of the tray. The base 10 may be welded to the tray, or attached by a screw and nut assembly passing through a hole 10' in the base (and an equivalent hole in the tray). Four half-dipole feed legs 11 are folded at right angles to the base 10.

Note that two of the four feed legs are obscured in FIG. 6. Each dipole also has a pair of arms which each extends at right angles to a respective feed leg 11 and away from a common central axis 9.

Each arm has a proximal part 25 which extends at right angles to the feed legs and radially away from the common central axis 9 at a slant angle of +/−45 degrees relative to the antenna centre line. Each arm also has a distal end which is split into three parts: namely a pair of outer parts 13, 14 and a central part 15. The central part 15 is bent so that it branches out at right angles out of a plane containing the proximal part 25 and the central axis 9. The central part 15 extends to the left for the +45 degree dipole 7 and to the right for the −45 degree dipole 8. This results in a shape as viewed in plan along the central axis 9 with rotational symmetry of order two.

Each arm is manufactured by splitting the end of the arm into three parts, and bending the central part 15 sideways.

The upper outer part 13 has parallel upper and lower edges. Similarly the lower outer part 14 has parallel upper and lower edges. The outer parts 13, 14 also converge inwardly towards the tip of the arm. The central part 15 has inwardly converging upper and lower edges.

Figure 7:
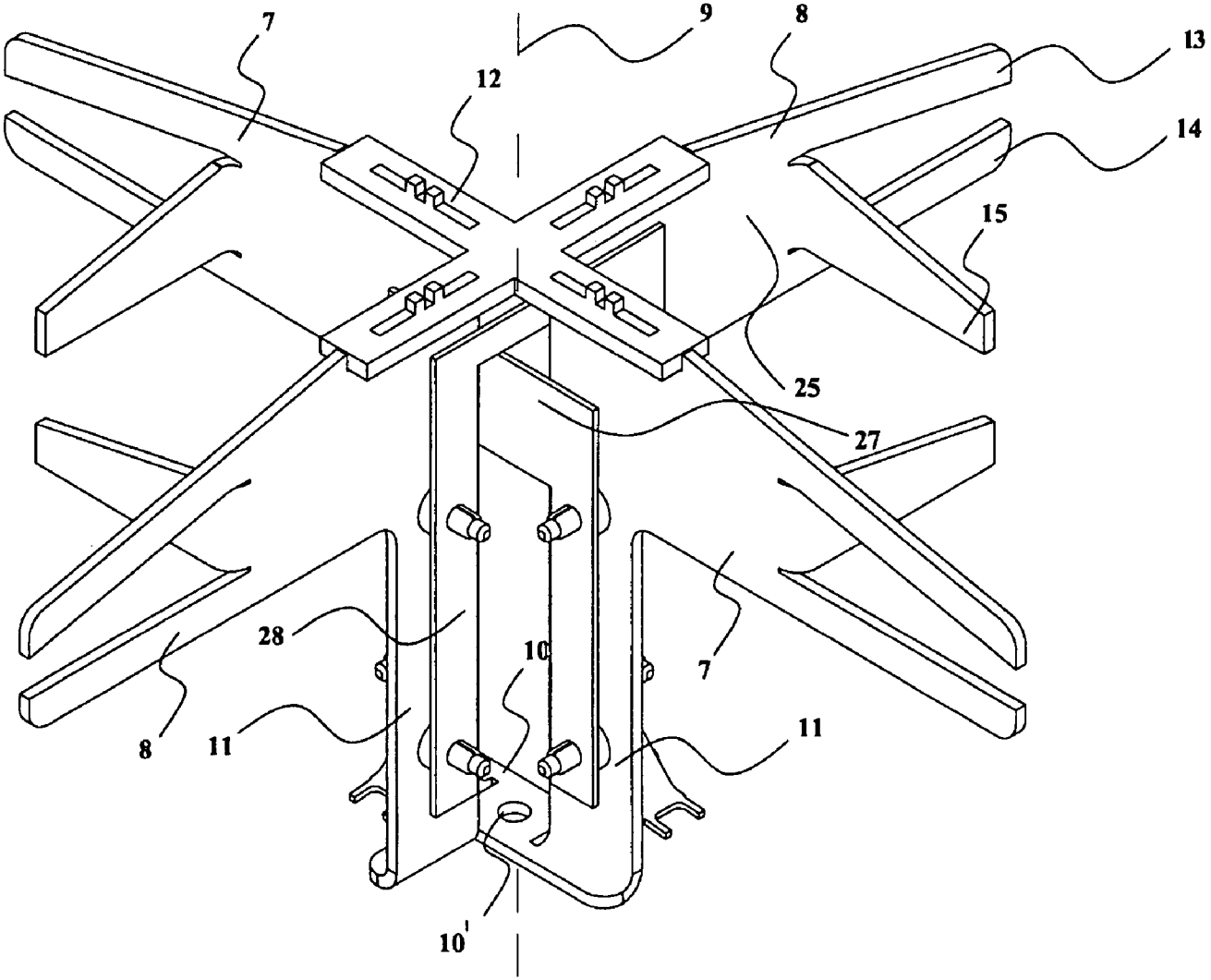
FIG. 7 is a perspective view of one of the dipole assemblies with the plastic clip and baluns included.

Referring to FIG. 7, the dipoles arms are held together rigidly by a non-conductive cross-shaped clip 12 described in further detail in U.S. Pat. No. 6,717,555.

Figure 2:
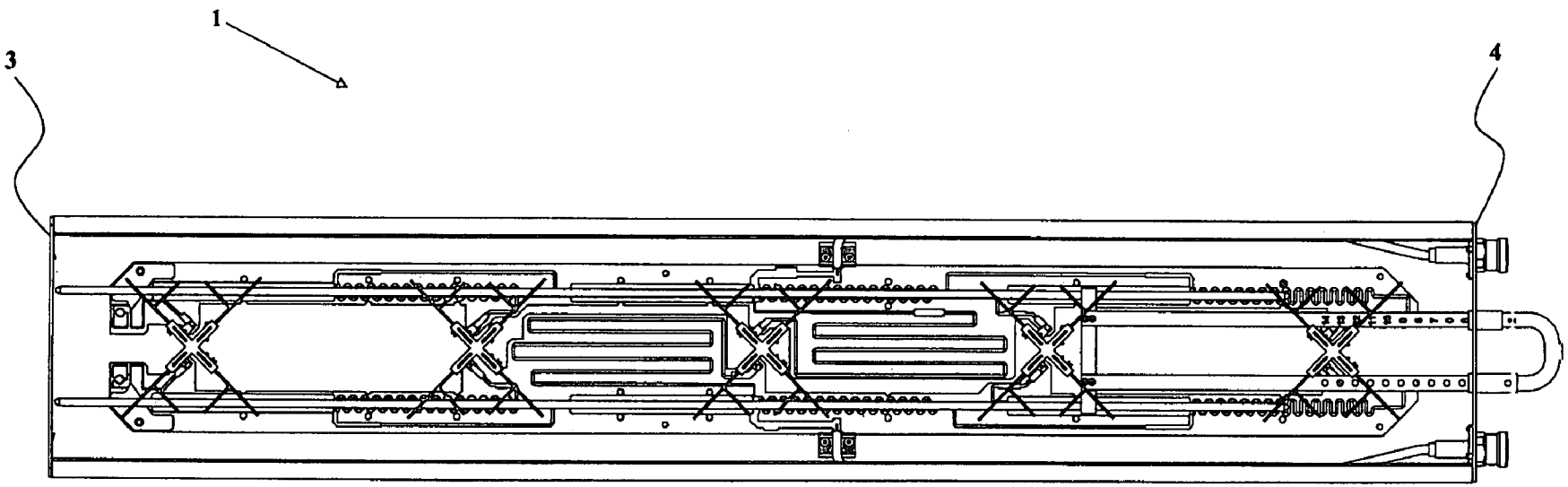
FIG. 2 is a plan view of the antenna.
Figure 3:
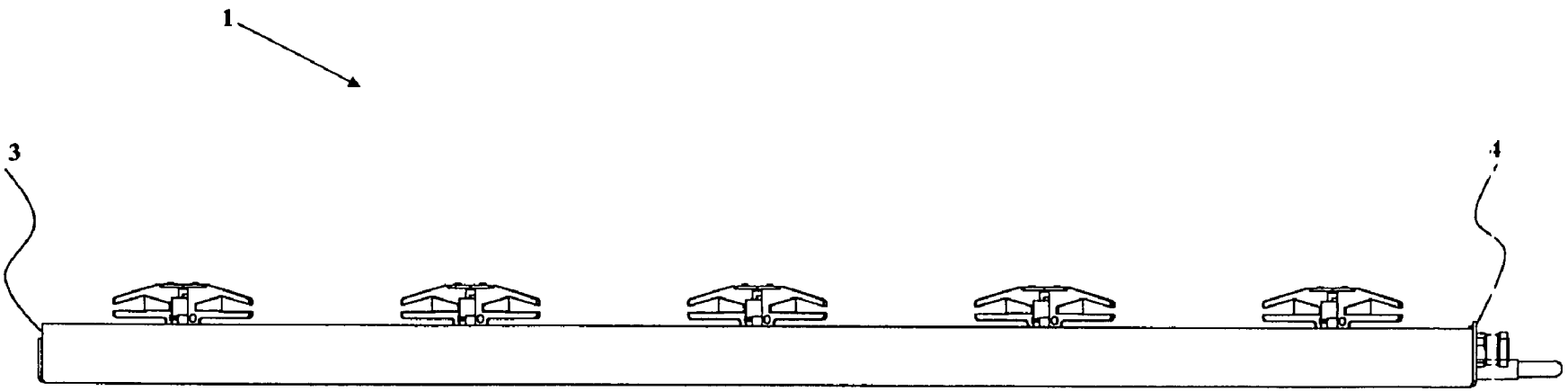
FIG. 3 is a side view of the antenna.
Figure 4:
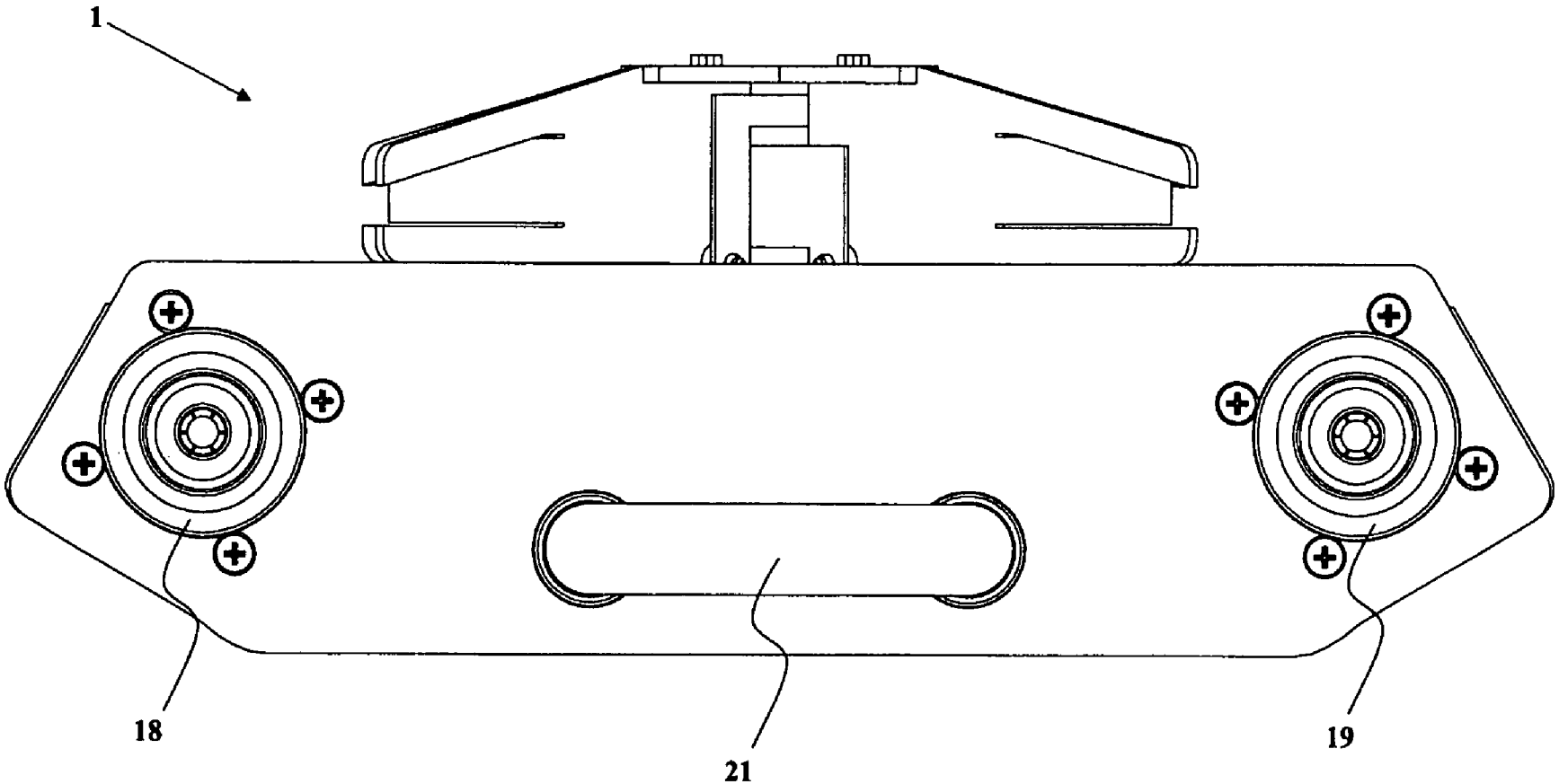
FIG. 4 is an end view of the antenna.

The dipole assemblies are mounted on a printed circuit board (PCB) 16 which carries an etched pattern of feedlines shown in FIGS. 1 and 2 leading to a pair of cables, one of which is shown at 17 in FIG. 1. Each cable leads to a respective port 18, 19. The +45 degree dipoles 7 are coupled to the port 18 and the −45 degree dipoles are coupled to the port 19.

Figure 8:
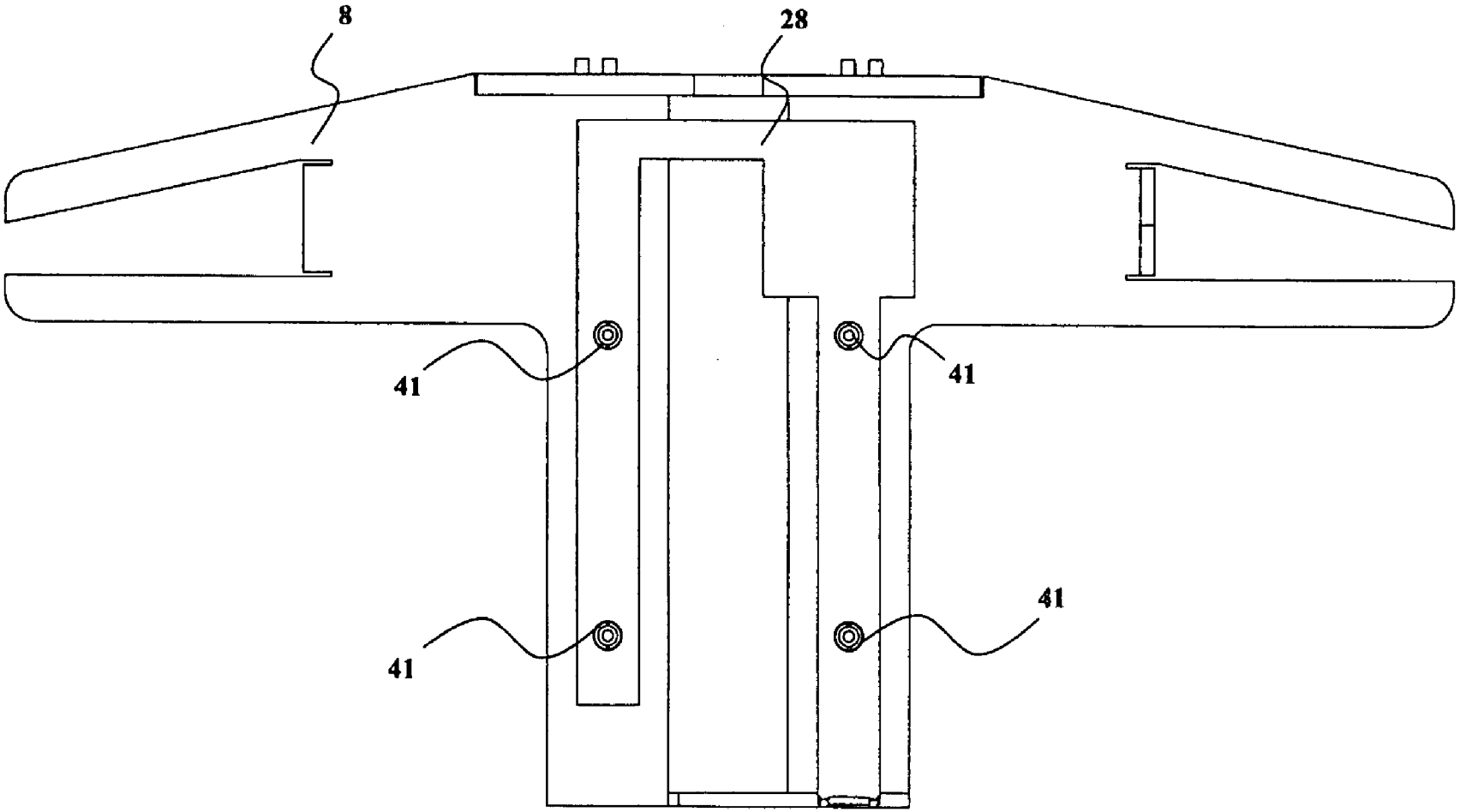
FIG. 8 is a side view showing the −45 degree dipole.
Figure 9:
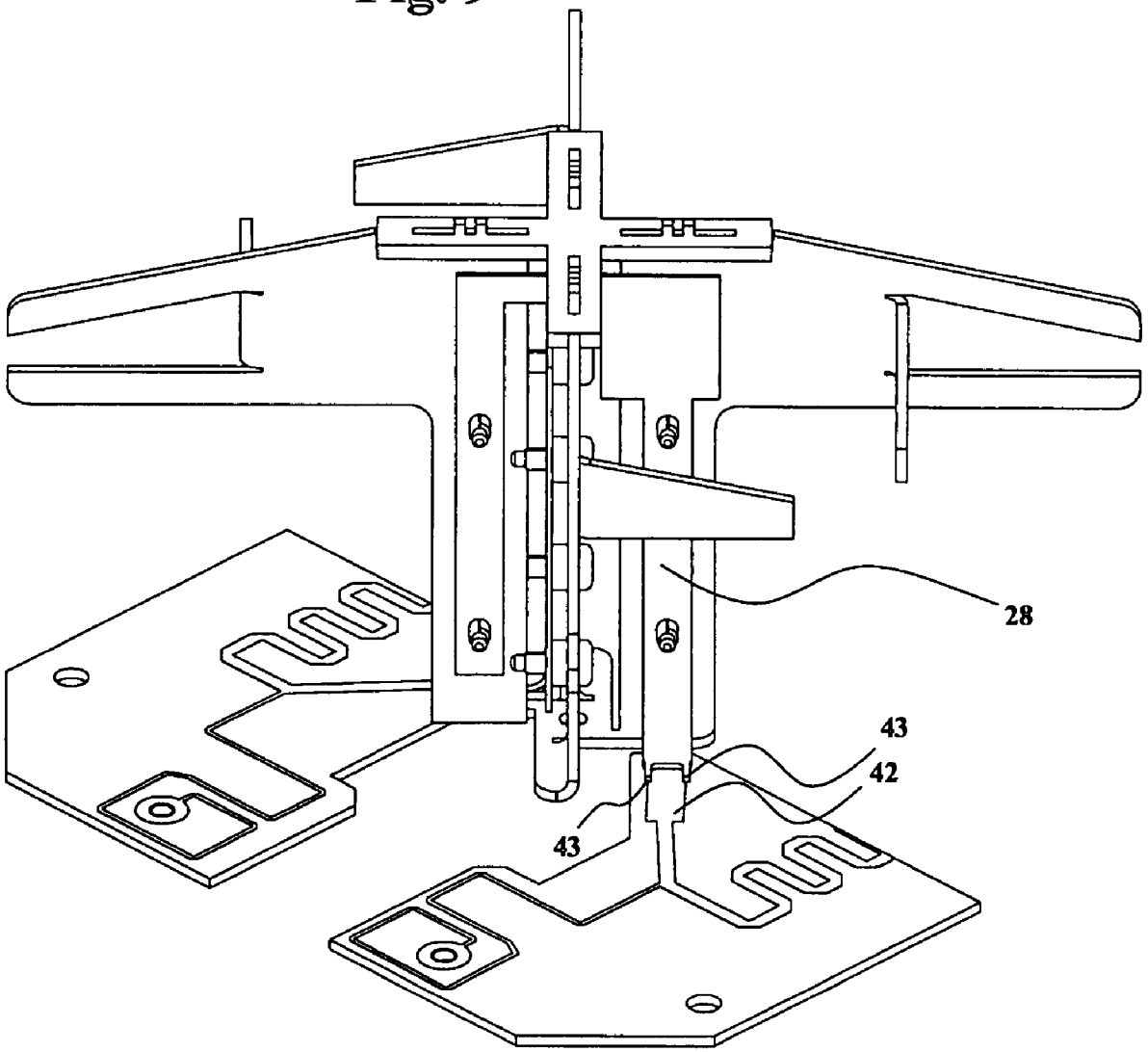
FIG. 9 is a perspective view of one of the dipole assemblies installed on the antenna.
Figure 10:
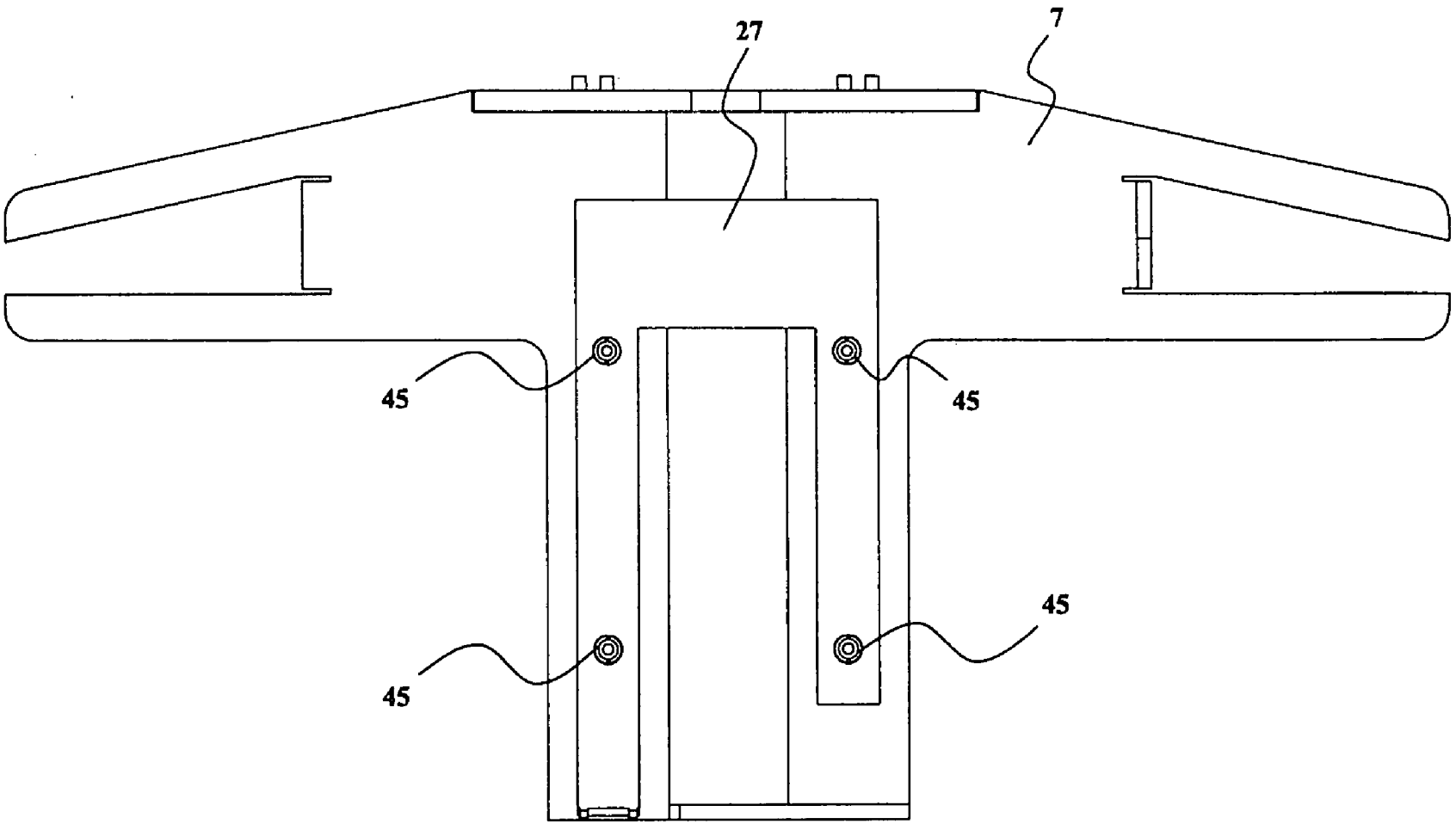
FIG. 10 is a side view showing the +45 degree dipole.

The microstrip feedlines are coupled to the dipoles by a balun feed arrangement shown most clearly in FIGS. 8–10. A hook-shaped brass balun transformer 28 shown in FIG. 8 is associated with the −45 degree dipole 8. The balun 28 matches the unbalanced feedline with the balanced pairs of dipole arms forming the dipole 8. The balun 28 is shaped like an inverted U. However, as seen in FIG. 8, in order to achieve a symmetrical pair of crossed dipoles, one leg of the inverted U is longer than the other leg. The balun 28 is attached to the dipole 8 by insulating connectors 41 (described in further detail in U.S. Pat. No. 6,717,555), and spaced from the dipole 8 by an air gap. The foot of the balun has a pair of stubs 43 which are soldered to a feedline 42 in the position shown in FIG. 9.

A similar balun 27 shown in FIG. 10 is associated with the +45 degree dipole 7. The balun 27 is attached to the dipole 7 by insulating connectors 45, and spaced from the dipole 7 by an air gap. The foot of the balun 27 is soldered to a feedline in a similar manner to the foot of the balun 28 shown in FIG. 9.

It is possible to consider the bent part 15 of the dipole arm as acting in a similar manner to a parasitic element. Currents on the bent part 15 radiate energy that cancels the energy which couples from one polarization to another, thereby causing an increase in isolation between the ports 18,19. Isolation is >30 dB for all angles of down tilt in a wide (>15%) frequency band.

The elimination of separate parasitic elements between the dipole assemblies makes the horizontal beam pattern more stable across the frequency band of the antenna, and improves side lobes in the vertical plane.

The proximal parts 25 of the dipole arms define four planes which intersect at the central axis. These four planes define four regions: namely left-hand and right-hand transverse regions which each contain a transverse line orthogonal to the side walls and passing through the central axis; and upper and lower axial regions which each contain the antenna axis (the antenna axis being an axial line parallel to the side walls and passing through the central axis). As shown most clearly in FIG. 2, the crossed dipole assemblies are oriented so that the bent parts 15 extend into the transverse regions (and not into the axial regions). Although the crossed dipole assemblies could be rotated by 90 degrees (so that the bent parts 15 extend instead into an axial region) this is thought to be less effective since the parts 15 are more remote from the side walls. Positioning the parts 15 in the transverse region is thought to create diffraction effects which act to cancel diffractive effects of the side walls (and hence improve isolation). These diffraction effects are likely to be less effective if the parts 15 extend into an axial region.

Positioning the parts 15 in the transverse region also has the effect of widening the azimuthal beam width of the antenna, which is desirable when a larger beam width is required, such as 90 degrees. To create 90 degree beam width, prior art crossed dipole assemblies usually require the dipole arms to be positioned 0.4 wavelengths above the ground plane with the dipole arms bent down. In the antenna of FIG. 1, the design of the dipole arms, in combination with the bent side walls, enables a 90 degree pattern with a reduced dipole height of 0.15–0.2 wavelengths above the ground plane.

Also, as confirmed by simulation, currents on the ground plane under the dipole are less widely spread compared with a traditional 90 degree dipole antenna, so it is possible to reduce the width of the base of the tray.

The reduced size of the antenna eases zoning issues, reduces weight, minimizes wind loading and reduces material and labor costs.

The reduced distance of the dipoles from the ground plane also gives a shape which is both low profile and aesthetically pleasing. The low profile also makes the dipole assembly well suited to use in a multi-band antenna, since the low profile dipole will have minimal effect on the performance of the other frequency band(s).

Although the horizontal beam width of the antenna is fixed, in an alternative antenna the horizontal beam width may be variable between 65 degrees and 90 degrees by varying the size and/or geometry of the side walls.

Figure 5:
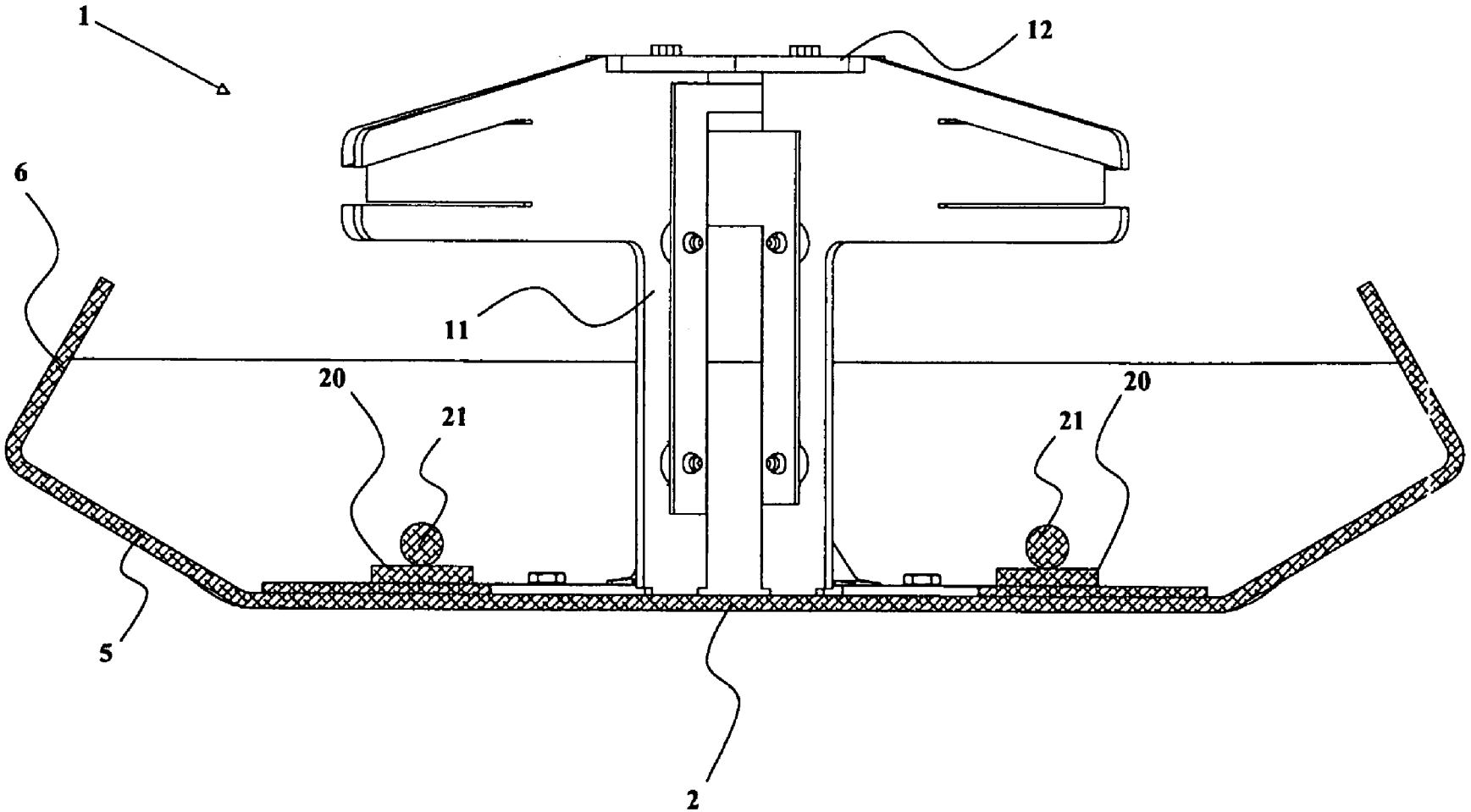
FIG. 5 is a cross-sectional view of the antenna.

Referring to FIGS. 1 and 5, phase shifters are provided which can be adjusted by a handle 21 to vary the relative phase between the dipole assemblies and hence vary the down tilt of the antenna beam. Two of the phase shifters are shown in cross-section in FIG. 5. The phase shifters include a dielectric rod 20 which lies adjacent to a feedline and can be moved along its length by the handle 21. The detailed construction of the phase shifters is described in further detail in U.S. Pat. No. 6,717,555.

Figure 11:
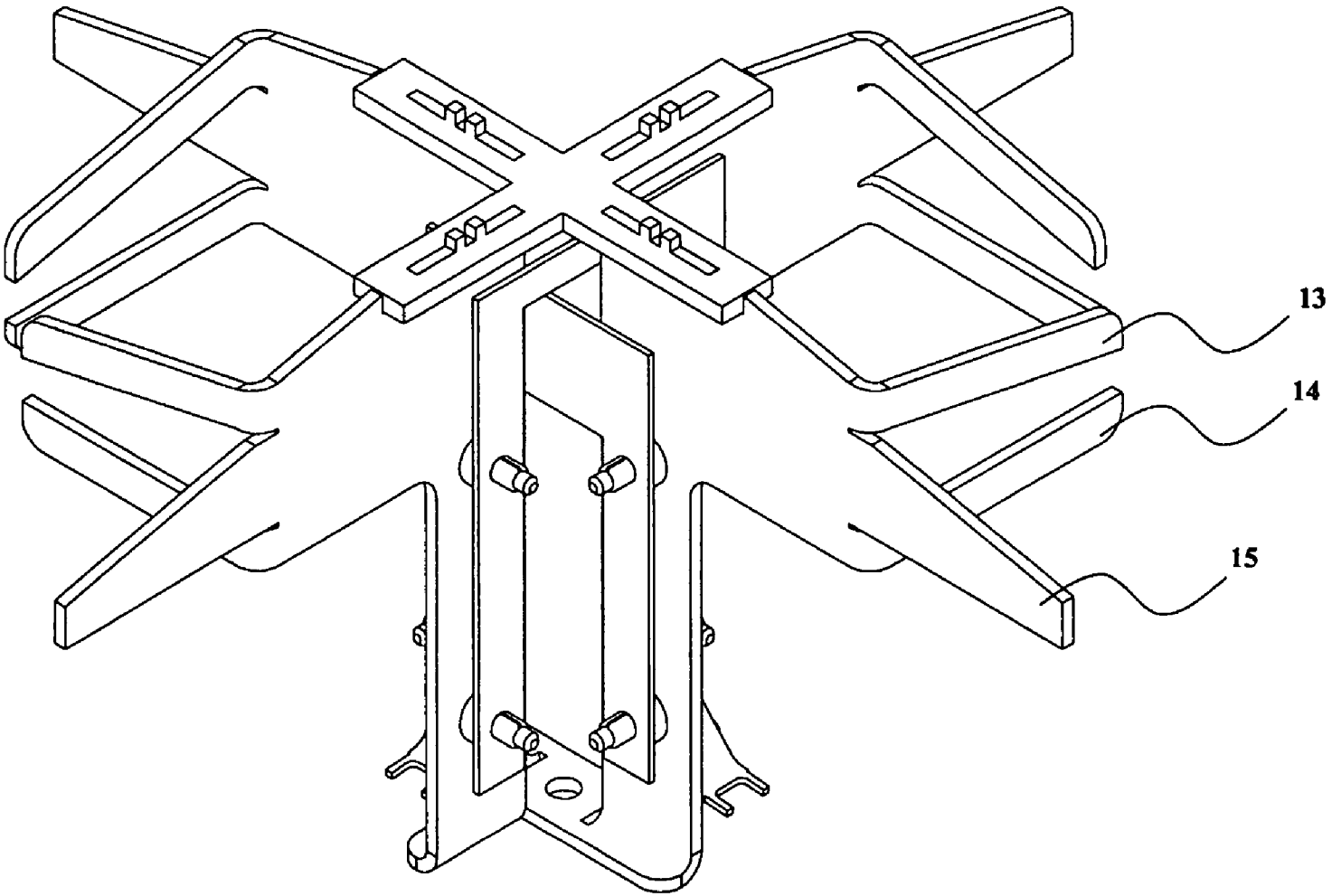
FIG. 11 shows a first alternative cross-dipole assembly.

FIG. 11 shows a first alternative cross-dipole assembly, replacing the assembly of FIG. 7. In this case the outer parts 13, 14 of the distal end of the dipole arms are bent at right angles out of the plane of the arm, instead of the central part 15. The FIG. 11 assembly has different beam width and bandwidth characteristics to the assembly of FIG. 7.

Figure 12:
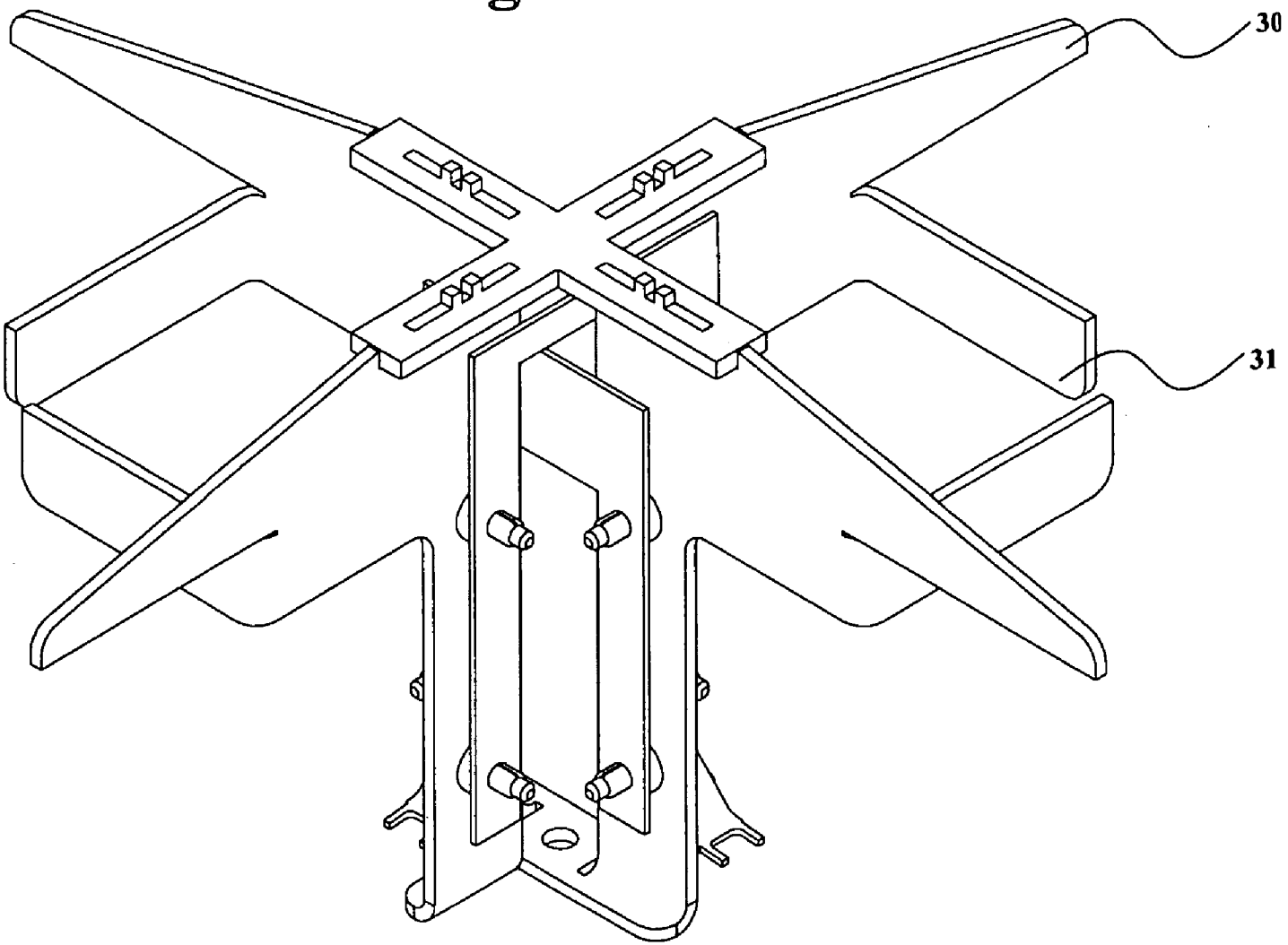
FIG. 12 shows a second alternative cross-dipole assembly.

FIG. 12 shows a second alternative cross-dipole assembly, replacing the assembly of FIG. 7. In this case the distal end of each dipole arm is split into only two parts instead of three parts: namely an upper part 30 and a lower part 31. The lower part 31 is bent at right angles out of the plane of the arm. The upper part 30 has inwardly tapering upper and lower edges, and the lower part 31 has parallel upper and lower edges. It is believed that the FIG. 12 assembly is likely to have a narrower bandwidth than the assembly of FIGS. 7 and 11, although it has the advantage of reduced labor costs since only a single split needs to be made at the distal end of each dipole arm.

Figure 13:
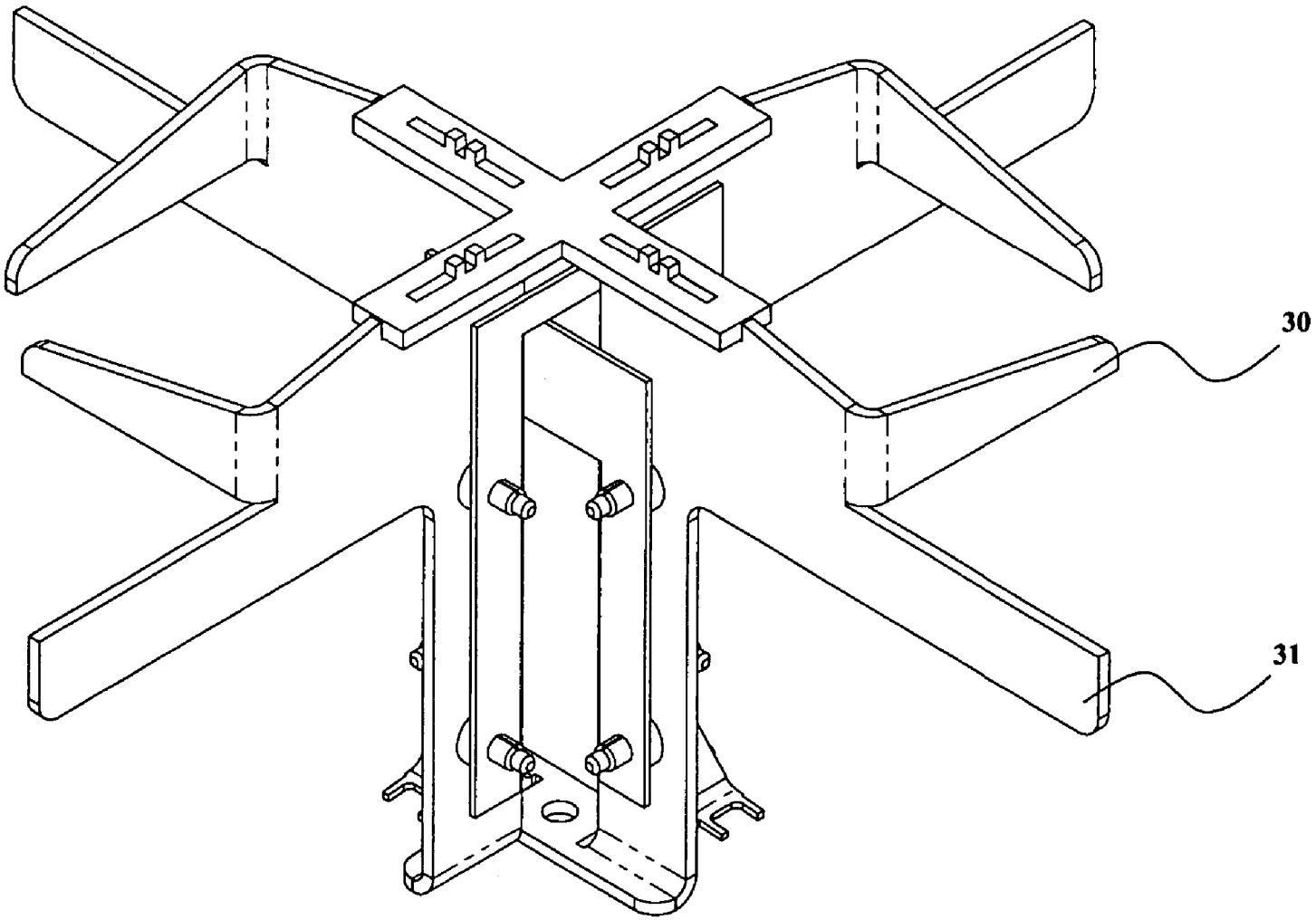
FIG. 13 shows a third alternative cross-dipole assembly.

FIG. 13 shows a third alternative cross-dipole assembly, replacing the assembly of FIG. 7. The assembly is similar to the assembly of FIG. 12 except the upper part 30 is bent at right angles out of the plane of the arm instead of the lower part 31.

Figure 14:
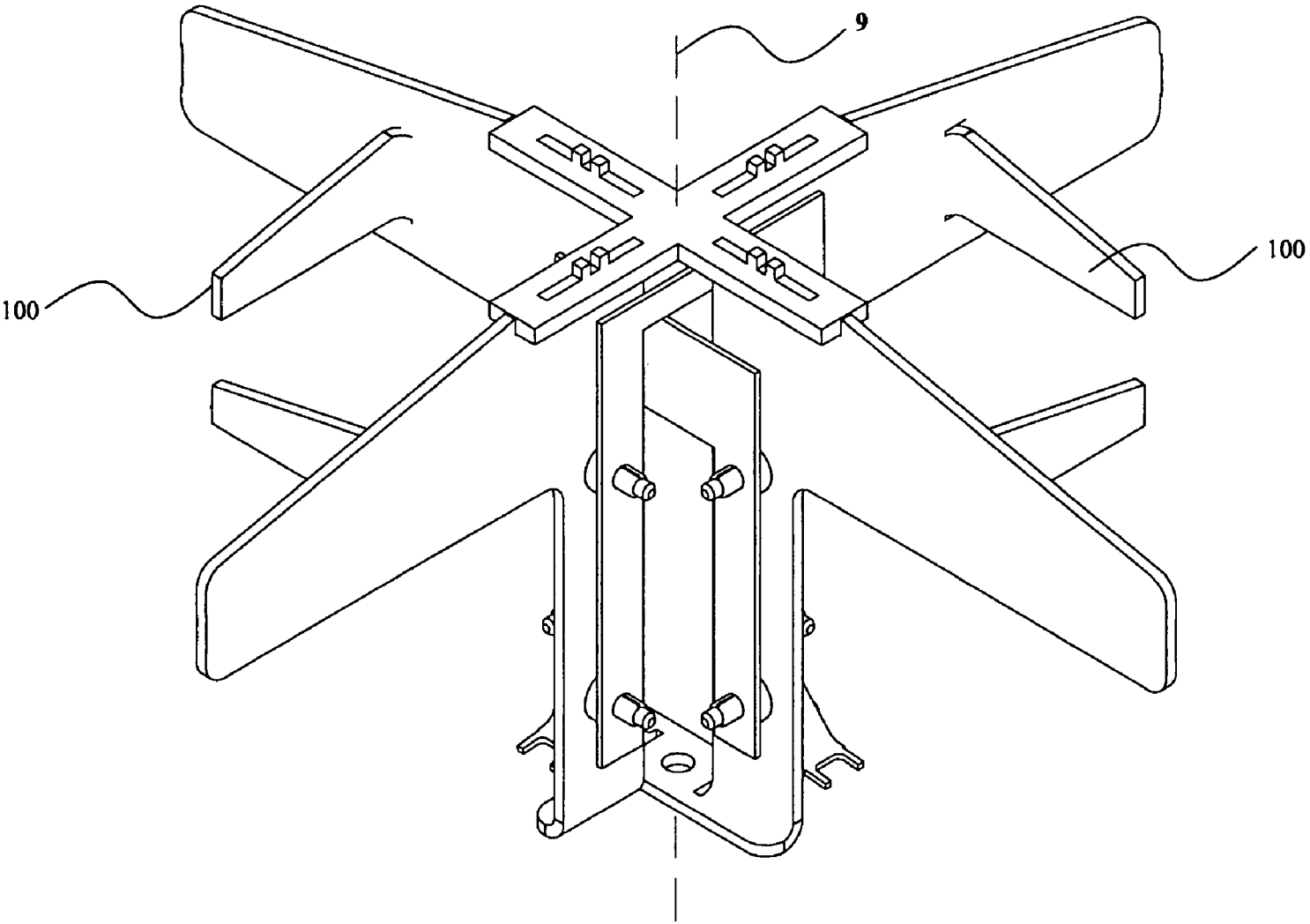
FIG. 14 shows a fourth alternative cross-dipole assembly.

FIG. 14 shows a fourth alternative dipole where instead of splitting and bending back part of the arms, a separate piece 100 is formed and welded or otherwise attached to each arm so that it branches out at an intermediate position along its length. The FIG. 14 assembly will have different beam width and bandwidth characteristics to the other assemblies, which may be more suited to some applications. However a disadvantage of the arrangement of FIG. 14 is the increased labor cost due to the piece 100 needing to be formed separately and attached.

Figure 15:
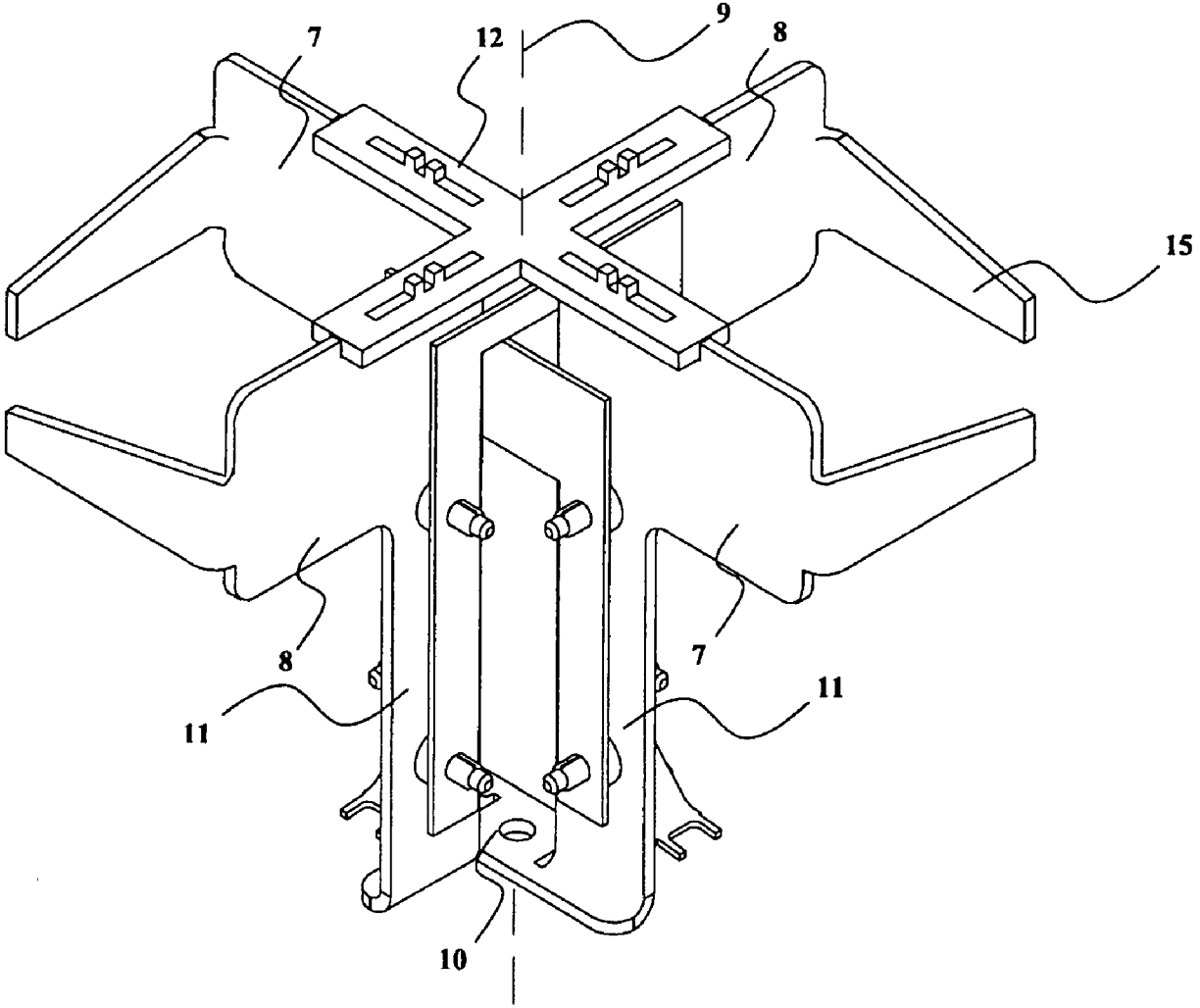
FIG. 15 shows a fifth alternative cross-dipole assembly.

FIG. 15 shows a fifth alternative dipole assembly where the outer parts 13, 14 are omitted. The assembly of FIG. 15 is likely to have a narrower bandwidth compared with the assemblies of FIGS. 1–14, but it is believed that the bent part 15 will continue to provide an improvement in isolation.

Figure 16:
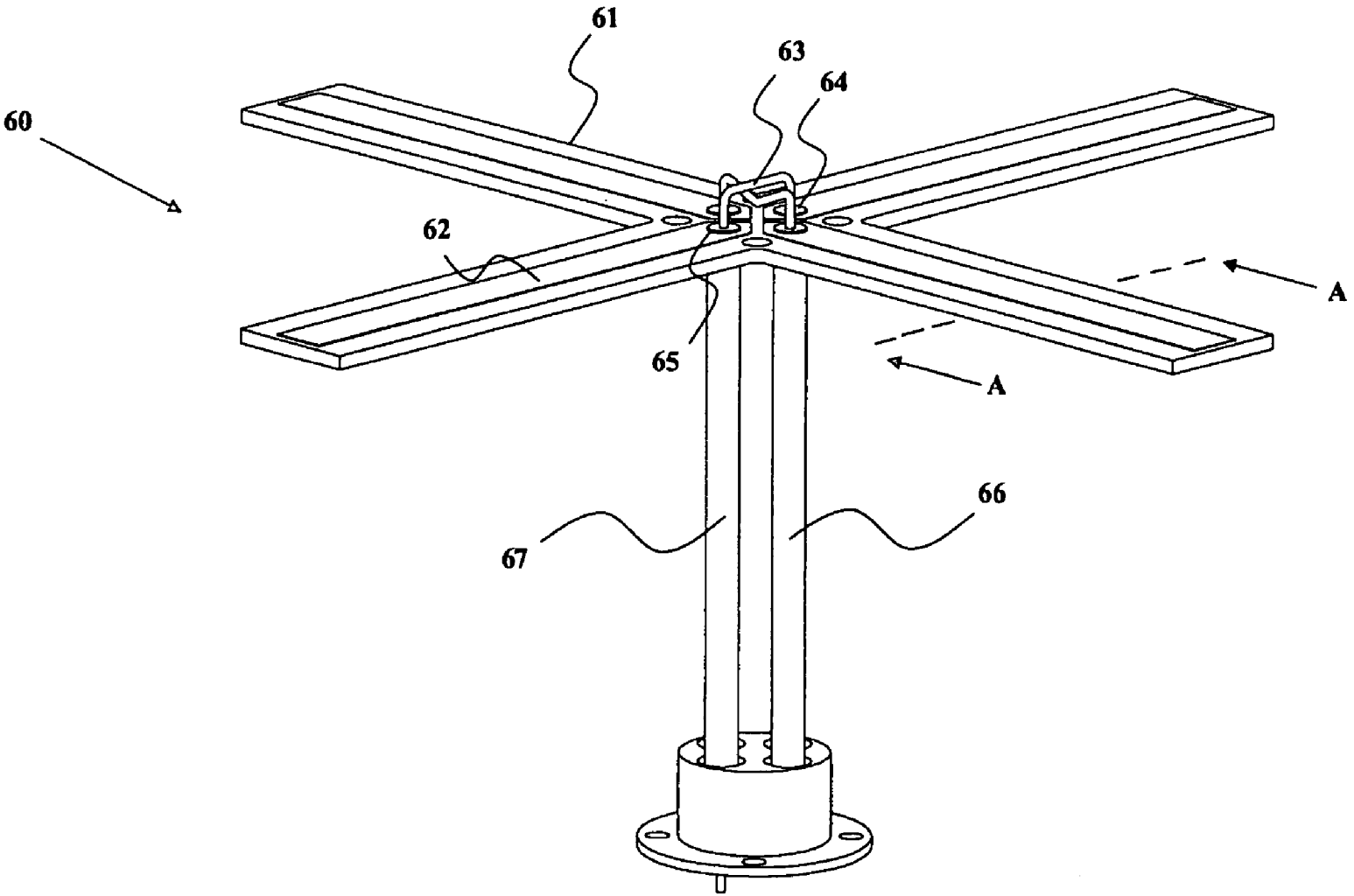
FIG. 16 shows a sixth alternative cross-dipole assembly, prior to attachment of the isolating fingers.
Figure 17:
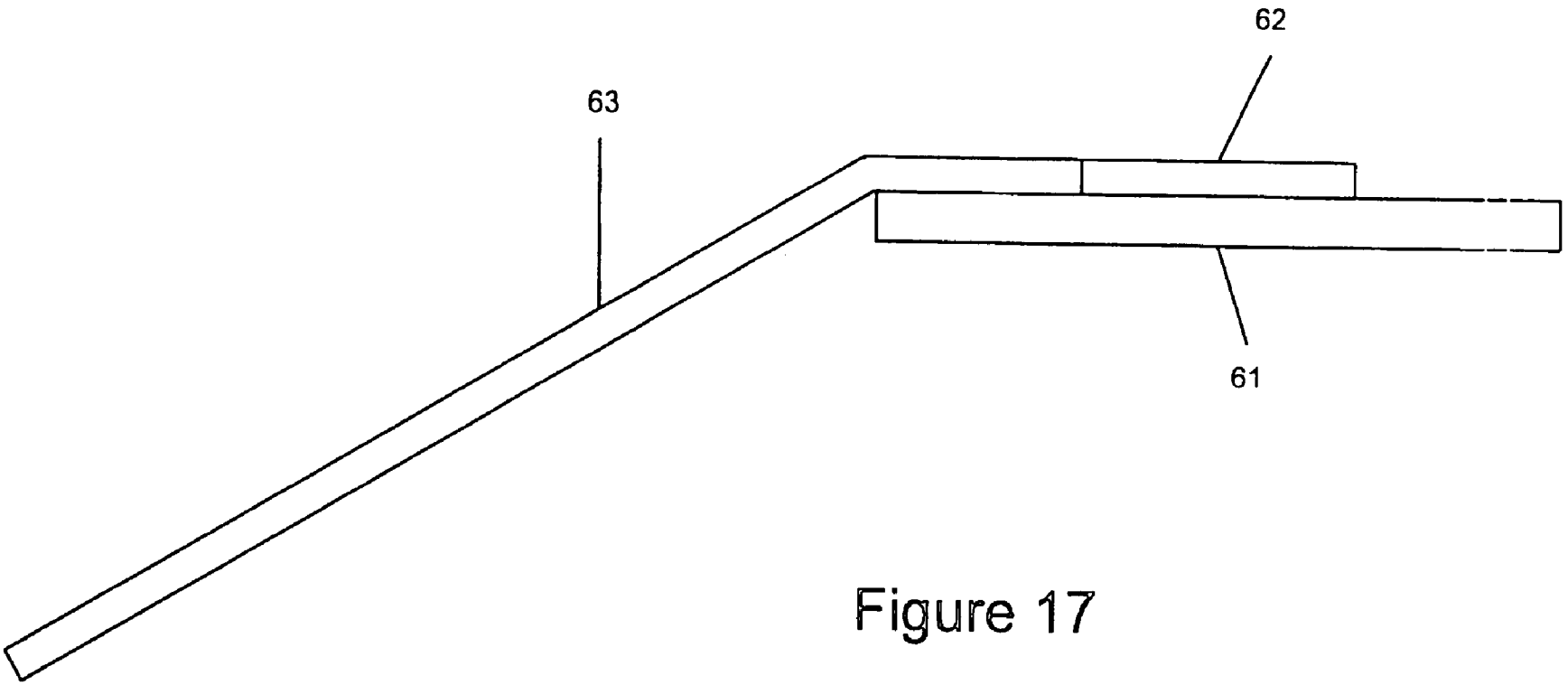
FIG. 17 is a cross-section along line A—A of the assembly of FIG. 16 after attachment of the isolating fingers.

FIGS. 16 and 17 show a sixth alternative cross-dipole assembly 60. The assembly includes a cross shaped printed circuit board (PCB) 61 on which is printed four dipole arms 62. The PCB is supported by four cylindrical supports. Two of the supports are shown at 66, 67 in FIG. 16 and the other two supports are hidden. The supports 66, 67 each contain a coaxial cable. The hidden supports are hollow cylinders or posts which do not contain coaxial cables. The coaxial cable within support 67 has an inner conductor 63 which is soldered to one of the dipole arms at 64, and an outer conductor (not visible) which is soldered to the opposite dipole arm at 65. The coaxial cable within support 66 is coupled to the other dipole in a similar way.

Four isolating fingers 63 are soldered to the dipole arms. The isolating fingers are omitted from FIG. 16, but one is shown in the cross-section of FIG. 17. The fingers 63 are brass strips having a similar height and width to the arms 62. Each strip is soldered to a respective arm at a point A—A approximately one third of the distance between the distal end of the arm 62 and the central axis. The length of the finger 63 is also approximately one third of the length of the arm 62. The finger 63 is conductively connected to the arm by a solder joint (not shown), and bent down at approximately 30 degrees out of the plane of the arm as shown in FIG. 17. A finger is attached to each arm, with the fingers attached to one dipole being directed to the left, and the fingers attached to the other dipole being directed to the right, in a similar manner to the bent parts 15 in the antenna of FIG. 1. In contrast with the antenna of FIG. 1, the assembly of FIGS. 16 and 17 is used in an antenna which does not include side walls. The provision of fingers 62 has been found to improve isolation.

In a seventh alternative dipole assembly (not shown) the bent parts 15 or isolating fingers 63 may all extend in the same rotational direction. In this case, the dipole assembly will have rotational symmetry of order four and is similar in this respect to a quadrifilar helix. The dipole assembly is likely to be suitable for use in a circularly-polarized antenna, instead of a dual-polarized antenna (as in FIGS. 1–17). It is believed that the branched arm configuration will be advantageous in a circularly-polarized antenna since it will result in a wider bandwidth.

In the embodiments described above, the distal end portion(s) of the arm (that is, parts 13, 14 in FIG. 6, part 15 in FIG. 11, part 31 in FIG. 12, part 31 in FIG. 13) extend radially from the central axis 9 (that is, they are in line with the proximal portion as viewed along the central axis). In an eighth alternative embodiment (not shown) the distal end portion(s) may be bent sideways out of a plane containing the proximal portion 25 and the axis 9, so they no longer extend radially from the central axis 9.

Although the parts 15 are bent at right angles to the proximal parts 25, in alternative designs (not shown) the parts may be bent by other angles such as 70 or 85 degrees. The performance of the antenna can be optimized (during design, manufacture and/or use of the antenna) by varying the angle of the parts 15.

The present invention is useful in wireless communication systems. One embodiment of the present invention operates in the Personal Communication System (PCS)/Personal Communication Network (PCN) band of frequencies of 1850–1990 and 1710–1880 MHz, respectively. Generally, wireless telephone users transmit an electromagnetic signal to a base station comprising a plurality of antennas which receive the signal transmitted by the wireless telephone users. Although useful in wireless base stations, the present invention can also be used in all types of telecommunications systems.

Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

What is claimed is:

1. A crossed dipole antenna element comprising first and second dipoles, each dipole having a pair of arms, each arm having a first portion extending from a central axis and a second portion extending out of a plane including the first portion and the central axis, wherein the second portions of the arms of the first dipole extend in a first rotational direction and the second portions of the arms of the second dipole extend in a second rotational direction.

2. An antenna element according to claim 1 wherein the second portion of each arm branches out from an intermediate position along the length of the arm.

3. An antenna element according to claim 1 wherein the second portion of each arm is formed by bending an end of the respective arm to one side.

4. An antenna element according to claim 1 wherein the four arms of the dipoles form a shape as viewed in plan along the central axis with a rotational symmetry of order two.

5. An antenna element according to claim 1 wherein the first dipole is formed from the same piece of material as the second dipole.

6. An antenna element according to claim 1 wherein the first portion of each arm tapers inwardly along all or part of its length.

7. An antenna element according to claim 1 wherein the second portion of each arm tapers inwardly along all or part of its length.

8. An antenna including a ground plane, and a crossed dipole antenna element according to claim 1 positioned adjacent to the ground plane.

9. An antenna according to claim 8 wherein the antenna is a dual-polarization antenna having a first port coupled to the first dipole and a second port coupled to the second dipole.

10. An antenna according to claim 8 further including a pair of conductive side walls positioned on opposite sides of the crossed dipole element.

11. An antenna according to claim 10 wherein the second portion of each dipole arm extends into a transverse region which is bounded by a first plane, a second plane, and one of the side walls, the first plane including one of the first portions and the central axis, and the second plane including another of the first portions and the central axis, the transverse region containing a transverse line which is orthogonal to the side walls and passes through the central axis.

12. A method of optimizing the performance of an antenna element according to claim 1, the method including varying the angle between the first and second portion of each arm to optimize the performance of the antenna element.

13. A crossed dipole antenna element comprising first and second dipoles, each dipole having a pair of arms, each arm including a first portion extending from a central axis and a second portion extending out of a plane including the first portion and the central axis, wherein the second portion of each arm branches out from the arm at an intermediate position along the length of the arm.

14. An antenna element according to claim 13 wherein the second portion of each arm is formed by bending part of the respective arm to one side.

15. An antenna element according to claim 13 wherein the first portion of each arm tapers inwardly along all or part of its length.

16. An antenna element according to claim 13 wherein the second portion of each arm is formed by splitting an end of the arm into two or more parts, and bending one or more of the parts to one side.

17. An antenna element according to claim 13 wherein the second portion of each arm tapers inwardly along all or part of its length.

18. An antenna element according to claim 13 wherein the second portion of each arm is formed by splitting an end of the arm into three parts, and bending a central one of the three parts to one side.

19. An antenna element according to claim 13 wherein the second portion of each arm is formed by splitting an end of the arm into three parts, and bending an outer pair of the three parts to one side.

20. An antenna element according to claim 13 wherein the second portion of each arm is formed by splitting an end of the arm into an upper part and a lower part, and bending the upper part to one side.

21. An antenna element according to claim 13 wherein the second portion of each arm is formed by splitting an end of the arm into an upper part and a lower part, and bending the lower part to one side.

22. An antenna element according to claim 13 wherein the first dipole is formed from the same piece of material as the second dipole.

23. An antenna element according to claim 13 wherein each arm includes one or more distal end portions extending from the central axis.

24. An antenna including a ground plane, and a crossed dipole antenna element according to claim 13 positioned adjacent to the ground plane.

25. A method of optimizing the performance of an antenna element according to claim 13, the method including varying the angle between the first and second portion of each arm to optimize the performance of the antenna element.

26. A method of manufacturing a crossed dipole antenna element comprising first and second dipoles, each dipole having a pair of arms, each arm having a first portion extending from a central axis and a second portion extending out of a plane including the first portion and the central axis, wherein the second portions of the arms of the first dipole extend in a first rotational direction and the second portions of the arms of the second dipole extend in a second rotational direction, the method including forming the second portion of each arm by bending an end of the respective arm to one side.

27. A method of manufacturing a crossed dipole antenna element comprising first and second dipoles, each dipole having a pair of arms, each arm including a first portion extending from a central axis, the method including splitting an end of each arm into two or more parts, and bending one or more of the parts to one side out of a plane including the first portion and the central axis.

* * * * *